United States Patent [19]

Haenni

[11] 4,300,420

[45] Nov. 17, 1981

[54] APPARATUS FOR CUTTING OF SHEET METAL SHEETS AND STACKING THE SEPARATED SHEET METAL SECTIONS

[75] Inventor: Eduard Haenni, Zofingen, Switzerland

[73] Assignee: Haemmerleag, Zofingen, Switzerland

[21] Appl. No.: 130,595

[22] Filed: Mar. 17, 1980

[30] Foreign Application Priority Data

Mar. 15, 1979 [DE] Fed. Rep. of Germany ..... 2910197

[51] Int. Cl.[3] ..... B21D 43/28

[52] U.S. Cl. ..... 83/92; 83/157; 271/217; 414/110

[58] Field of Search ..... 271/217, 218; 414/91, 414/110; 83/89–94, 104, 157

[56] References Cited

U.S. PATENT DOCUMENTS 3,217,902 11/1965 Bishop ..... 414/91

4,242,024 12/1980 Buta ..... 271/217 X

FOREIGN PATENT DOCUMENTS 2458655 6/1976 Fed. Rep. of Germany ..... 83/157

*Primary Examiner*—James M. Meister

*Attorney, Agent, or Firm*—Abraham A. Saffitz

[57] ABSTRACT

The apparatus comprises a sheet metal shears at a cutting station which station is provided with a lifting table 13 which is vertically adjustable, is used for cutting off small sections of sheet metal from a sheet and also is used for stacking these sections on a pallet 15. This lifting table extends through a cut-out side wall 5 for the shears and thus permits the shifting of an already piled-up stack 16 away from the shears, and then upwardly so that an adjacent stack 16*a* may be piled up neatly in spaced apart relation with stacks separated from each other by at least the thickness of the cut-out side wall. The continuing movement of the lifting table 13 after erecting the first stack 16 causes a small drop at the cut-off sections which are placed on the pallet 15, so that an orderly piled-up stack 16*a* develops. As the height of the stack increases the lifting table is gradually lowered until the predetermined height of the stack is reached.

4 Claims, 14 Drawing Figures

Fig. 2
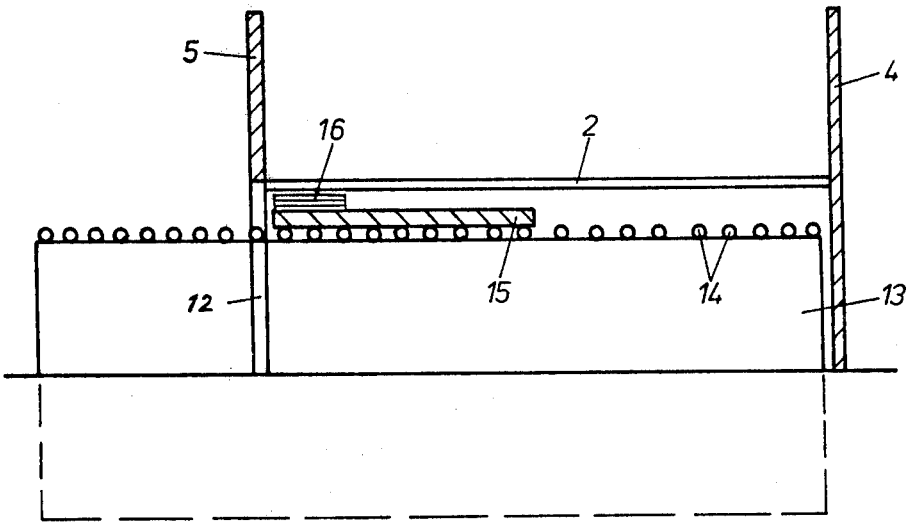
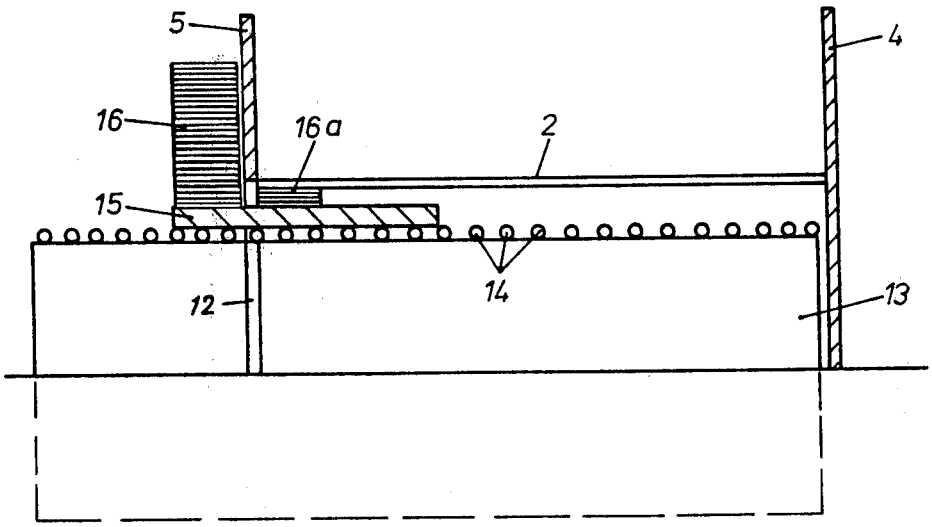
Fig. 3

APPARATUS FOR CUTTING OF SHEET METAL SHEETS AND STACKING THE SEPARATED SHEET METAL SECTIONS

BACKGROUND OF THE INVENTION (a) Field of the Invention

The present invention relates to an apparatus for cutting of sheet metal sheets and for stacking of the separated sections of sheet metal. The apparatus has a metal shear with a metal feed table, at the rear edge of which a fixed lower blade is disposed, which cooperates with an upper blade mounted swivellably between two lateral supports. In the plane of the feed table for the metal, behind the place of cutting, a supporting device, shiftable in its plane perpendicularly to the cutting members and below it, a lifting table which is, adjustable in height is disposed which after withdrawal of the support device, receives the separated section of sheet metal. A stop is provided at a certain adjustable distance behind the lower knife, against which the edge of the sheet metal to be cut, rests in order to determine the width of the sheet metal section thus. After the cut the separated strip of sheet metal lies on the support device and then drops after withdrawal of it downwards onto a stacking surface, so that gradually a stack of sheet metal sections is formed.

Naturally it is desirable that this stack be piled up uniformly and in orderly fashion, in order to avoid subsequently a time consuming and cumbersome manual rearrangement of the stack. This may be achieved by keeping the height of the drop of the section of sheet metal as small as possible. The lift-table adjustable vertically serves this purpose. In practice, a pallet may be used as stacking surface which is disposed on the lifting table. The lifting table is located immediately behind the lower knife and is moved at the start of operation into an upper end position, so that the surface of the pallet lies by a certain, small amount—depending on the thickness of the sheet metal to be cut—below the pallet of the sheet metal feed table. After a few strips of sheet metal are cut and stacked on the pallet, the lift-table is lowered somewhat in order to put the surface of the stack thus formed again into some distance below the plane of the feed table. This process is repeated, until the lift-table has reached its lower end position or the stack its intended height. The lowering of the lifting table may at the same time take place, controlled either manually or automatically, say with the help of a light-barrier, step by step or continuously. As a result, one will make sure that the cut off sections of the sheet metal always pass through only a short stretch in their free drop, so that a neat, uniform stack will be formed.

(b) Description of the Prior Art

Although such an arrangement has in principle proven itself very well, still there is a significant disadvantage, whenever small sheet metal sections are made. Such a stack of small sections under certain circumstances only takes up a small part of the surface of a pallet, whereby it would be desirable, however, to place several such stacks side by side. As soon however, as the first stack is completed, the lifting table can no longer be driven up, since the existing stack would abut against the support. Therefore people had been forced hitherto either to leave the capacity of the pallet unused, by only forming one stack per pallet or by putting up with a second disordered stack beside it since the cut of sheet metal sections have to pass through relatively large a distance in a free drop.

OBJECT OF THE INVENTION

It is an object of the present invention to avoid this disadvantage and to propose an apparatus with which several neatly stacked piles of separated sheet metal sections may be stacked up side by side.

SUMMARY OF THE INVENTION

At the same time one starts out from an apparatus of the initially mentioned type. According to the invention this device is distinguished by the side by side stacking in spaced apart relation of stacks of cut sections with the separation being at least the thickness of the the recess, said recess permitting the lifting and lowering of the lift-table and whereby there is a stacking and transporting part for forming of several sheet metal stacks, shiftable obliquely to the sheet metal feed.

After forming the first stack, it is guided while the lifting table is lowered, out of the area of the support mechanism into a position outside of the lateral support so that the lift-table together with the stack and transportation part may be lifted with its unoccupied surface up to the support means for the reception of a new stack. The surface of the lift-table may be provided with a roller train and a conventional pallet may be placed on this roller train.

BRIEF DESCRIPTION OF THE DRAWING

An embodiment of the apparatus as in the invention will be described in more detail in the following with reference to the attached drawings.

FIGS. 2–3 are schematic elevational views taken from the rear of the apparatus and partly in section and FIGS. 4–14 show the different stages of depositing the separated sheet metal sections on to the support means.

DESCRIPTION OF THE PREFERRED EMBODIMENT

Figure 1:
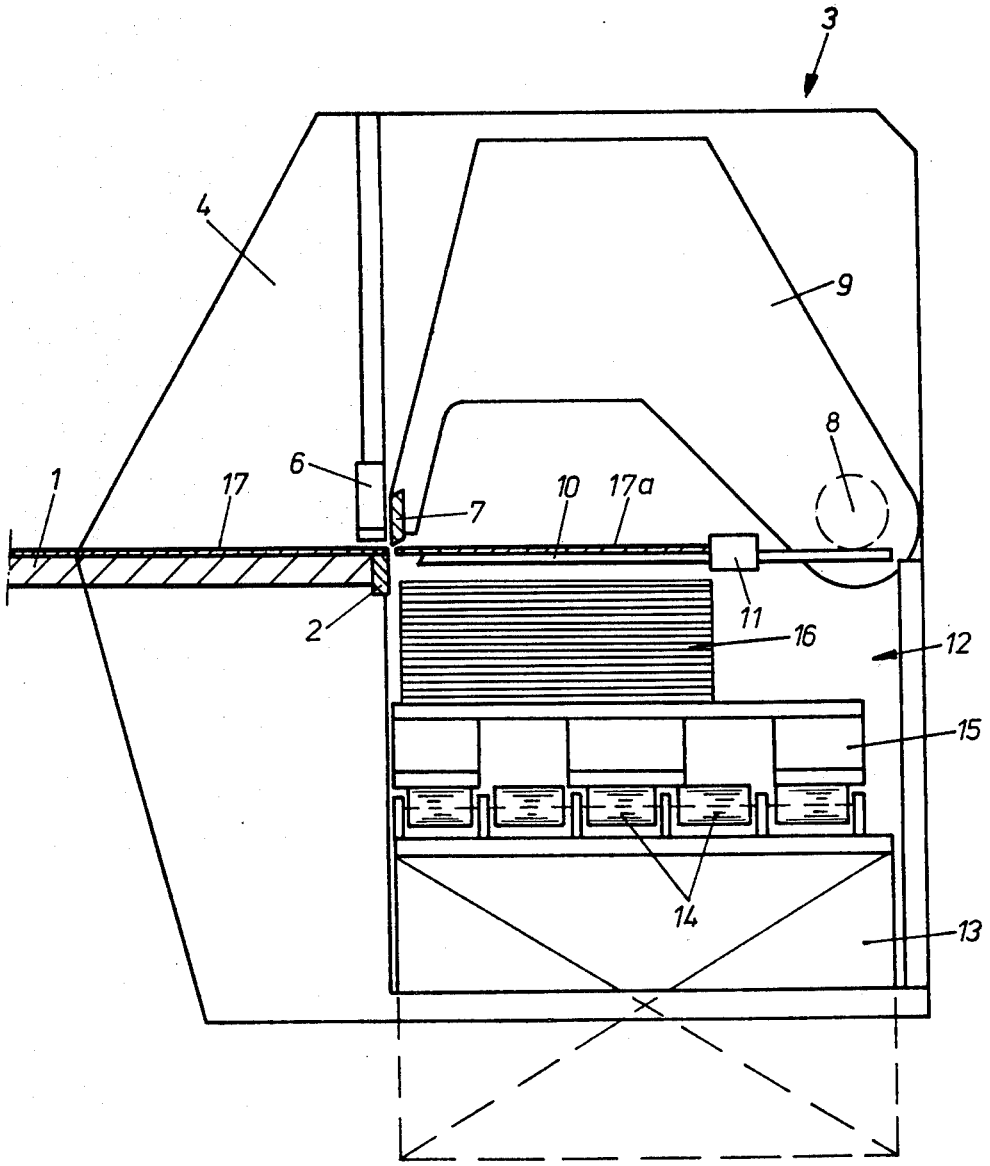
FIG. 1 is a schematic side view partly in section.

FIG. 1 shows a sheet-shears which is provided with a sheet metal feed table 1 at the rear end of which a fixed lower knife 2 is fastened. These parts are mounted in a machine frame 3, which is limited on both sides by side walls 4 and 5. A press pad 6 takes care so that a metal sheet that is to be cut, cannot shift. The fixed lower knife 2 cooperates with an upper knife 7, which is mounted in an over arm 9 for the knife, swivellable around an axis 8. A shiftable support mechanism 10 is disposed behind the lower knife 2 in the plane of the feed table 1, which is provided with likewise shiftable stops 11.

The support mechanism may consist of a number of parallel bars which extend backward away from the lower knife 2. The function of the support mechanism as well as of the stops will be discussed in more detail further on.

The one side wall 5, in FIGS. 2 and 3 has been perforated, so that a free passage 12 has been formed behind the lower knife 2. The height of the passage 12 corresponds to about the height of the feed-table 1. Behind the cutting place a lift-table 13 has been disposed, the development of which shall not be discussed here in more detail. As is apparent from FIGS. 2 and 3, it extends from the continuous side wall 4 over the width of the sheet shears and through the passage 12 still somewhat beyond the shears. On its top side it is provided with a number of rollers 14 which are rotatable around axes running perpendicularly to the lower knife 2. A pallet 15, placed on the roller train developed such, is thus shiftable in parallel to the lower knife 2, and to be sure, within the shears along the knife 2 and out of the shears right through the passage 12. The pallet 15 serves for the reception of stacks 16 of separated sheet metal sections.

The method of operation of the device is as follows:

The lift table 13 with put-up pallet 15 is lifted into an upper end position, in case of which the surface of the pallet 15 lies barely below the cutting place or below the support mechanism 10. Then the sheet-metal sheet to be cut is inserted until its edge fits against the preadjusted stop 11. The sheet metal section to be separated is supported at the same time by the support mechanism 10. After operation of the press pad 6, the cutting takes place with the help of the two knives 2 and 7, so that the separated sheet metal section 17*a*, lies on the support mechanism 10. After the cut, the support mechanism 10 is pulled to the rear, whereby the stop 11 remains on the spot. As a result, the sheet metal section 17*a* drops down onto the pallet 15, whereby it only has to pass through a short stretch in a free fall, because the pallet 15 has been brought nearly to the level of the knife 2 by the lifting table 13. Subsequently the support mechanism 10 is again brought forward into its starting position, so that the next sheet metal section may be supported correspondingly and may be separated.

After a few cuts, whenever the stack has reached a certain level, the lifting table 13 and thus the pallet 15 must be lowered somewhat. This may be accomplished with manual or automatic control, for example, with the help of a light barrier, which monitors the height of the stack 16 and upon reaching a border value brings about the lowering of the lifting table 13. In this way, each separated sheet metal section 17*a* must pass only through an optimally short path in free fall, so that a neatly stacked, orderly stack 16 develops.

As soon as the lifting table 13 has reached its lower end position, or whenever the stack 16 is piled to the predetermined level, the pallet 15 is shifted on rollers 14 out of the sheet shears, after which the lift-table 13 may again be moved into its upper end position. This situation is shown in FIG. 3. Now an additional stack 16*a* may be piled up beside the stack 16, whereby the distance between stacks 16 and 16*a* is limited downward by the thickness of side wall 5. The upward movement of the lifting table 13 at the same time is possible easily, since enough free space is available outside the shears in an upward direction, so that the already piled-up stack 16 cannot abut anywhere.

Now the second stack 16*a* is piled-up in a corresponding manner, until it reaches its prescribed height. Since the lifting table 13 is again in its lower position, the pallet 15 may again be shifted sideways by the width of the stack 16*a* plus the thickness of the sidewall 5, in order to make a renewed upward movement of the lift-table 13 possible. Thus several stacks 16 may be piled side by side onto the pallet 15, depending on the width of the cut-off sheet metal sections, whereby it is always guaranteed that the sheet metal sections pass only through a short stretch in free fall, so that orderly, neatly piled stacks 16 develop. Thus an optimal use of space on the pallet 15 is ensured. As soon as the pallet 15 is full, it is completely pulled from out of the sheet shears and may be taken over for example, by means of a stacker truck and fed to additional processing.

Figure 4:
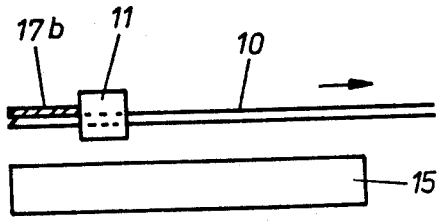

In case of small sheet metal sections it will be effective and necessary in the interest of an optimum use of the pallet to dispose several stacks 16, 16*a* etc., side by side not only in the longitudinal extent of the knife 2, but also to pile up several stacks, consecutively. This operating sequence is sketched in FIGS. 4–14, and may be explained as follows:

FIG. 4: A separated sheet metal section rests on the support mechanism 10 and with its rear edge touches the stop 11. The pallet 15 is still empty. The support mechanism 10 is now shifted in the direction of the arrow, rearward, whereby the stop 11 remains on the spot.

Figure 5:
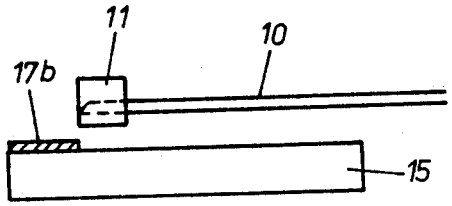

FIG. 5: The support mechanism 10 is in its rear end position and the sheet metal section 17*b* has dropped down onto the pallet 15.

Figure 6:
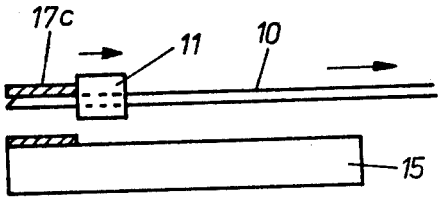

FIG. 6: The support mechanism 10 was again shifted forward and the next sheet metal section 17*c*, had been separated. It now abuts against the stop 11 and rests on the support mechanism 10. The latter together with stop 11 is now shifted rearward in the direction of the arrow.

Figure 7:
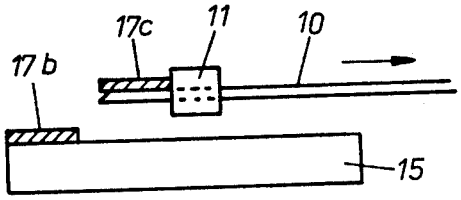

FIG. 7: The sheet metal section 17*c* lies on the pallet 15 above a free spot, immediately behind section 17*b*. The stop 11 is stopped, the support mechanism 10, however, is fed in the direction of the arrow.

Figure 8:
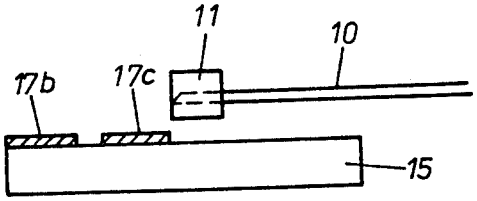

FIG. 8: The support mechanism 10 is shifted entirely to the rear and section 17*c* has dropped onto the pallet 15, where it rests behind the section 17*b*.

Figure 9:
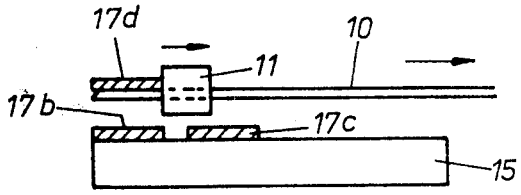

FIG. 9: Support mechanism and stop had again be brought into their starting position and the next separated sheet metal section 17*d* rests on the support mechanism 10. The latter together with the stop 11 is moved in the direction of the arrow toward the rear.

Figure 10:
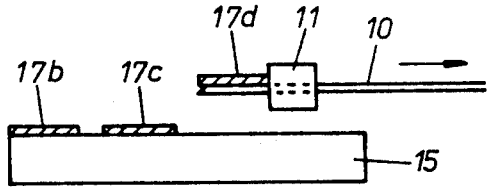

FIG. 10: As soon as an empty spot on the pallet 15 has been reached, the stop 11 is arrested, the support mechanism however, is moved farther to the rear.

Figure 11:
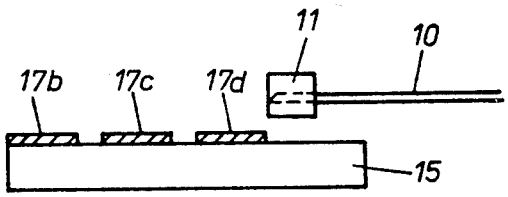

FIG. 11: The support mechanism 10 is in its rear-end position and the section 17*d* has dropped down onto the pallet 15 where it lies behind section 17*c*.

Figure 12:
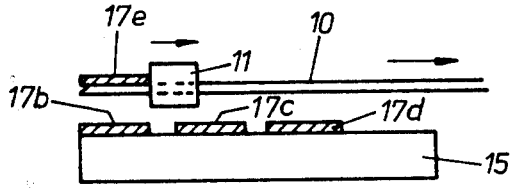

FIG. 12: The support mechanism 10 together with the stop 11 has again been returned into the starting position. The next separated sheet metal section 17*e* lies on the support mechanism.

Figure 13:
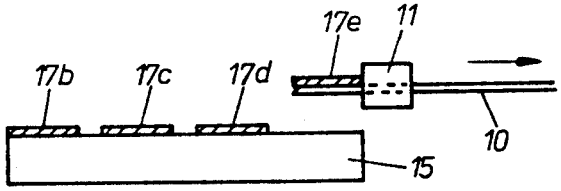

FIG. 13: The support mechanism 10 together with the stop 11 has been shifted to the rear until the section 17*e* has arrived above the last spot, still open in this stack series on pallet 15. The stop 11 is now arrested.

Figure 14:
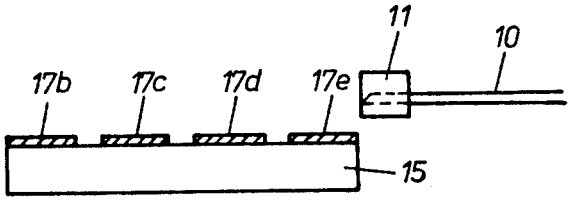

FIG. 14: With stop 11 standing still, the support mechanism 10 has been moved farther back and section 17*e* has dropped onto the pallet 15 where it rests behind section 17*d*.

Now the entire cycle starts all over again, by depositing the next following section of sheet metal onto sheet metal section 17*b*, already lying on pallet 15, the following section of sheet metal is deposited onto the section 17*c* and so forth. The four stacks 16 gradually grow; and the pallet 15, which is placed on the roller train of the lift-table 13, is lowered somewhat. By the alternating casting off of the separated sections of sheet metal onto the successive four stacks 16, they grow simultaneously until they have reached their predetermined height. Now the pallet 15 may be shifted somewhat laterally out of the sheet shears, as had already been described previously and the next series of stacks may be built up in a corresponding manner.

This process permits an optimal use of the space available on the pallet 15, whereby it will always be assured that neatly piled stacks 16 develop, since the sections of sheet metal will only drop a short distance in a free fall.

Naturally, the courses of movement of the support mechanism 10 and of stop 11 may be controlled automatically, for example under the influence of an electronic NC control instrument. This may also be used possibly for the control of the lifting and lowering movement of the lift-table 13.

The proposed apparatus does not merely permit an optimal use of space of pallet 15, with simultaneous orderly stacking, but also makes possible a quick and safe operation since the subsequent manual restacking and aligning of the stacks 16 may be omitted altogether.

I claim:

1. In apparatus for cutting sheet metal sections and for stacking the separated sheet metal sections having a feed table for sheet metal, a fixed lower knife disposed at the rear edge of said table, an upper knife and a support means in the plane of said feed table for feeding sheet metal into the cutting location between said upper knife and lower knife, that improvement consisting of:

two side supports each having a predetermined thickness disposed above said lower knife for mounting said upper knife;

an adjustable lifting table having a flat surface for the support of the sheet metal cut at said cutting location;

means for shifting said lifting table in a direction perpendicular to the plane of said feed table;

a recess in one of two said two side supports adjacent said upper knife to adapt dropping of cut sections and stacking of a plurality of spaced apart stacks side by side in which the spacing between stacks is at least as great as the thickness of said one side support having said recess;

swivelable mounting means for said upper knife which adapts cutting of said sheet and dropping of the cut sheet onto a stack;

a support means on which stacks of cut sheets are provided by said stacking and transporting means;

said lifting table adapted to be lifted and lowered by a lifting mechanism through said recess and thereby adapting said lifting table for transverse shifting to the direction of the sheet metal feed from said feeding table to said upper and lower knives;

stacking and transporting means shifting transversely to the direction of said sheet metal feed towards said upper knife;

guiding means adjacent said lower knife for guiding said lifting table in a lower direction by the supporting mechanism in a location outside of one of the two said side supports whereby said lifting table is moved together with said stacking and transporting means for receiving a new stack of sections which have been cut by said cutting knives.

2. Apparatus as claimed in claim 1 including rollers which rotate about an axis perpendicular to the cutting direction of the lower knife on the surface of said lifting table.

3. Apparatus as claimed in claim 2 including a pallet on which side rollers are supported.

4. Apparatus as claimed in claim 2 including shiftable stops connected to said support mechanism for stopping the transfer of cut sections from the cutting location onto the support mechanism.

* * * * *